US008115147B2

(12) United States Patent
Thomas et al.

(10) Patent No.: US 8,115,147 B2
(45) Date of Patent: Feb. 14, 2012

(54) INDUCTION HEATING SYSTEM OUTPUT CONTROL BASED ON INDUCTION HEATING DEVICE

(75) Inventors: Jeffrey R. Thomas, Appleton, WI (US); Randall G. Baxter, Black Creek, WI (US); Paul D. Verhagen, Appleton, WI (US)

(73) Assignee: Illinois Tool Works Inc., Glenview, IL (US)

( * ) Notice: Subject to any disclaimer, the term of this patent is extended or adjusted under 35 U.S.C. 154(b) by 1454 days.

(21) Appl. No.: 11/144,898

(22) Filed: Jun. 3, 2005

(65) Prior Publication Data

US 2006/0289493 A1 Dec. 28, 2006

(51) Int. Cl.
*H05B 6/04* (2006.01)
*H05B 6/06* (2006.01)

(52) U.S. Cl. ..... 219/660; 219/663

(58) Field of Classification Search ..... 219/660–668, 219/630–633, 671, 677; 323/634, 603, 297; 363/97, 144
See application file for complete search history.

(56) References Cited

U.S. PATENT DOCUMENTS

| | | | | |
|---|---|---|---|---|
| 1,853,101 | A | 4/1932 | Von Henke | |
| 5,461,215 | A | 10/1995 | Haldeman | |
| 6,043,471 | A | 3/2000 | Wiseman et al. | |
| 6,528,771 | B1 * | 3/2003 | Matsen et al. | 219/634 |
| 6,693,413 | B1 * | 2/2004 | Lanni | 323/297 |
| 6,727,483 | B2 | 4/2004 | Thomas et al. | |

* cited by examiner

*Primary Examiner* — Quang Van
(74) *Attorney, Agent, or Firm* — Fletcher Yoder, P.C.

(57) ABSTRACT

In one exemplary embodiment, the induction heating system includes an induction heating power source. The induction heating power source is operable to identify an induction heating device coupled to the induction heating power source. The exemplary induction heating power source is operable to automatically limit power based on the identity of the induction heating device.

23 Claims, 10 Drawing Sheets

INDUCTION HEATING SYSTEM OUTPUT CONTROL BASED ON INDUCTION HEATING DEVICE

BACKGROUND OF THE INVENTION

The present invention relates generally to induction heating and, particularly, to a system for controlling the output of an induction heating power source based on the induction heating device coupled to the induction heating power source.

Induction heating is a method of heating that utilizes a varying magnetic field to heat a work piece. This varying magnetic field is produced by transmitting an alternating current through an induction heating device. A work piece located inside or in close proximity to the induction heating device is exposed to the varying magnetic field, inducing movement of electrons and causing a flow of eddy currents within the work piece. These eddy currents and resistance to current flow within the work piece cause the temperature of the work piece to rise. Thus, the amount of heat induced in the work piece may be controlled by changing the magnetic field strength as a result of varying the amount of alternating current flowing through the induction heating device.

An induction heating system typically comprises an induction heating power source and an induction heating device that is coupled to the induction heating power source. Again, alternating electrical current flowing from the induction heating power source and through the induction device produces the varying magnetic field. In traditional induction heating systems, several different kinds of induction heating devices may be coupled to the same induction heating power source. For example, a given induction heating power source may supply power to an air-cooled induction heating device or, alternatively, a liquid-cooled induction heating device, for example.

Different induction heating devices, however, present different operating limits. That is, certain operating parameters that may be appropriate for one kind of induction device may lead to damage of a second kind of induction device. Indeed, different induction heating devices may have varying limits with respect to the amount of electrical current that may flow through the given induction heating device before damage is a concern. Thus, although the same induction heating power source may be used to operate these different induction heating devices, the induction heating power source may be operable to produce an output undesirable to the coupled induction heating device, potentially causing damage to the induction heating device. Therefore, a technique to mitigate the likelihood of the operating limits of an induction heating device from being exceeded is desirable.

SUMMARY OF THE INVENTION

In accordance with certain exemplary embodiments, the present invention provides systems and methods for inductively heating a work piece. In one exemplary embodiment, the induction heating system includes an induction heating power source. The induction heating power source is operable to identify the type of induction heating device coupled to the induction heating power source. Additionally, the induction heating power source is operable to automatically impose limits on the output parameters to the induction heating device based on the identity of the induction heating device.

BRIEF DESCRIPTION OF THE DRAWINGS

The invention will hereafter be described with reference to the accompanying drawings, wherein like reference numerals denote like elements, and.

DETAILED DESCRIPTION

Figure 1:
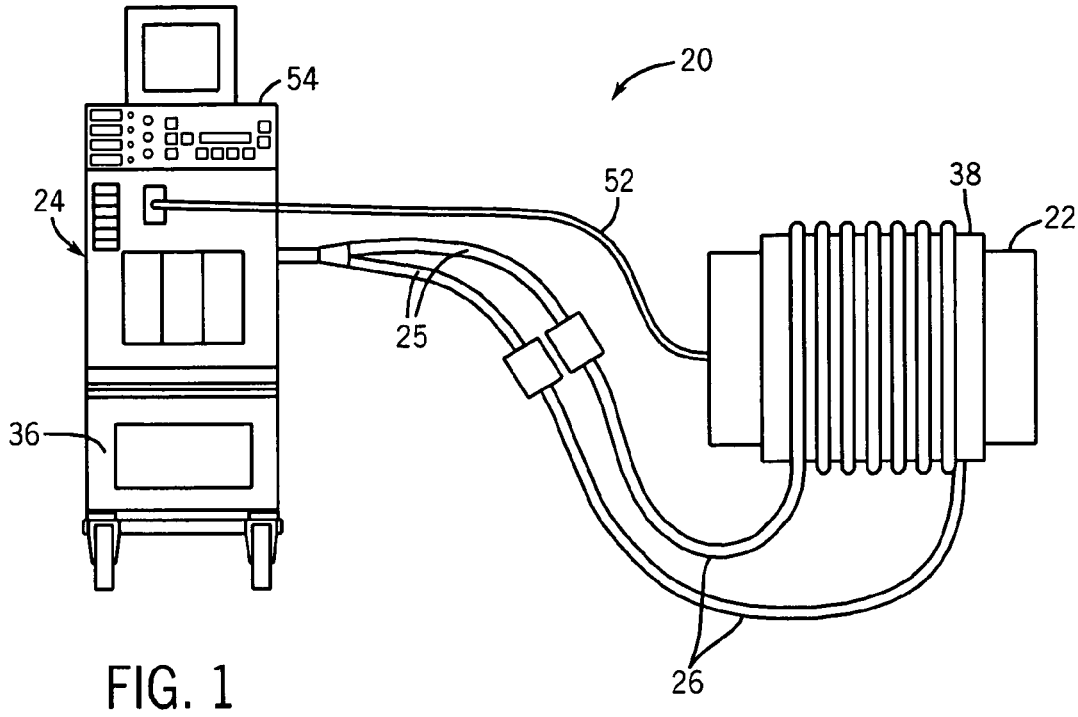
FIG. 1 is a diagrammatic illustration of an induction heating system, according to an exemplary embodiment of the present technique.

Referring generally to FIG. 1, a system 20 for inductively heating a work piece 22 is illustrated. In FIG. 1, the work piece 22 is a pipe comprising two circular pipe sections welded together and surrounded by a protective thermal blanket 38. However, it is worth noting that the induction heating system 20 is operable to inductively heat a variety of different work pieces. In the illustrated embodiment, the induction heating system 20 comprises an induction heating power source 24, a fluid cooling unit 36, a fluid-cooled extension cable 25, and a fluid-cooled induction heating cable 26. The fluid-cooled induction heating cable 26 is flexible to enable the fluid-cooled induction heating cable 26 to be wrapped around the work piece 22 to form a coil. Alternatively, the induction heating system 20 may comprise an induction heating power source 24, an air-cooled extension cable, and an air-cooled induction heating cable or an air-cooled induction heating blanket, which are discussed further below. (See FIGS. 16-18).

Figure 2:
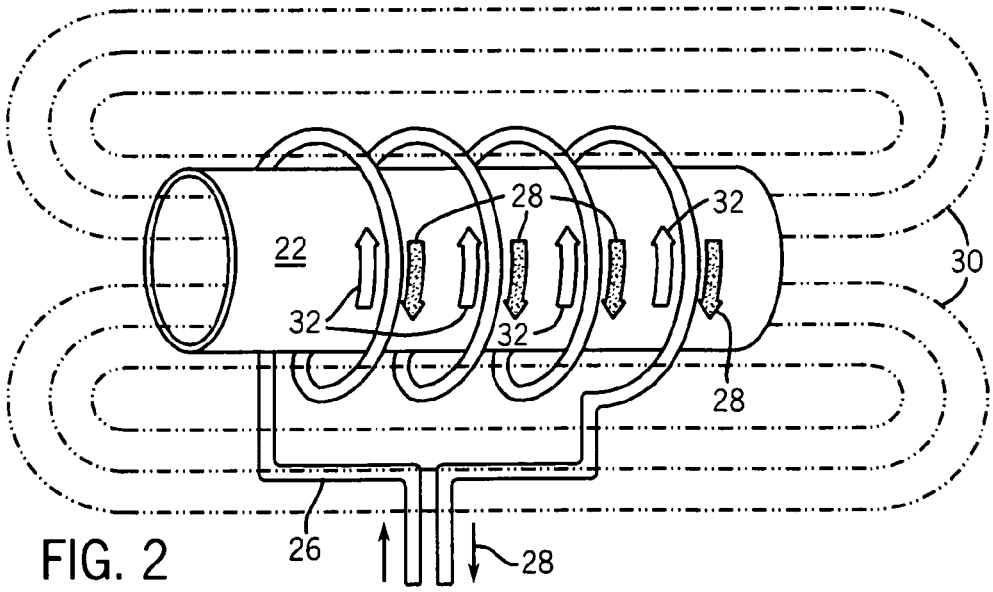
FIG. 2 is a diagram of the process of inducing heat in a work piece using a varying magnetic field, according to an exemplary embodiment of the present technique.

As illustrated in FIG. 2, the induction heating power source 24 is operable to produce an alternating electrical current 28 that is conducted through the fluid-cooled extension cable 25 to the fluid-cooled induction heating cable 26. The alternating electrical current 28 flowing through the fluid-cooled induction heating cable 26 produces a varying magnetic field 30 that induces a flow of eddy currents 32 in the work piece 22 and that, in turn, heats the work piece 22. Accordingly, controlling the level of the alternating electrical current from the induction heating power source 24 changes the strength of the magnetic field, thereby controlling the amount of heat generated in the work piece 22.

Figure 3A:
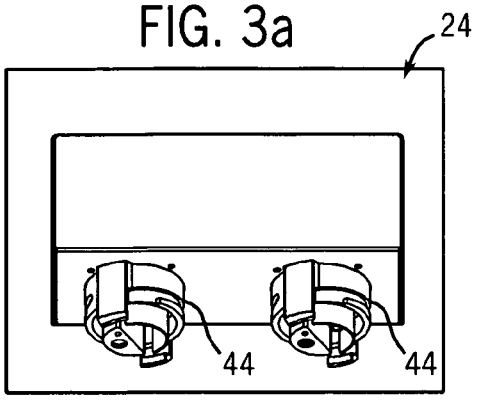
FIGS. 3*a*, 3*b*, 3*c*, and 3*d* are elevation views of a rear portion of the induction heating system of FIG. 1, FIG. 3*a* illustrating a pair of power source output connectors, FIG. 3*b* illustrating the pair of power source output connectors with a protective cover on one connector, FIG. 3*c* illustrating a pair of fluid-cooled extension cables coupled to the power source output connectors, and FIG. 3*d* illustrating a pair of air-cooled extension cables coupled to the power source output connectors.
Figure 3B:
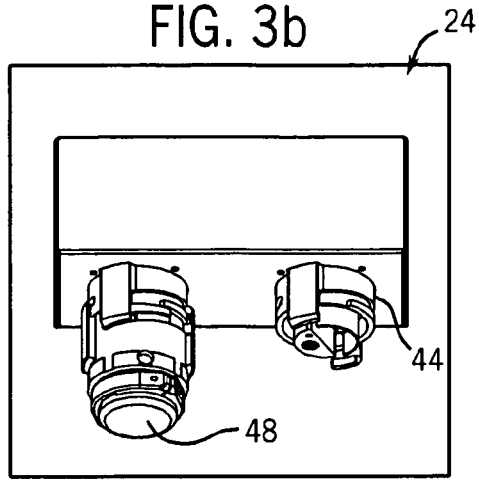
Figure 3C:
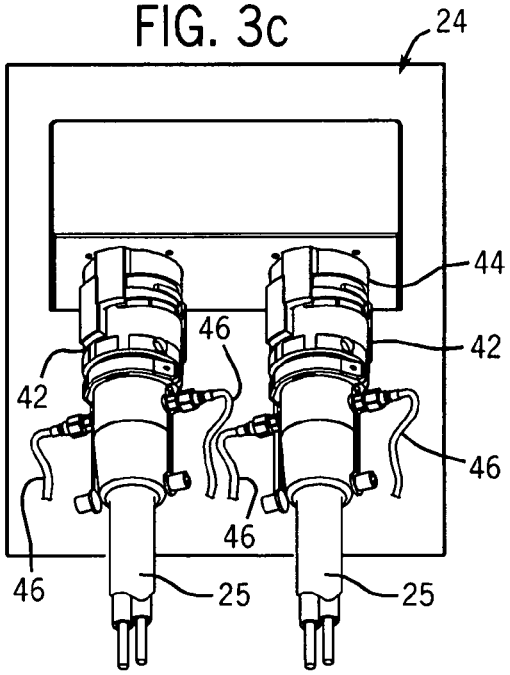
Figure 3D:
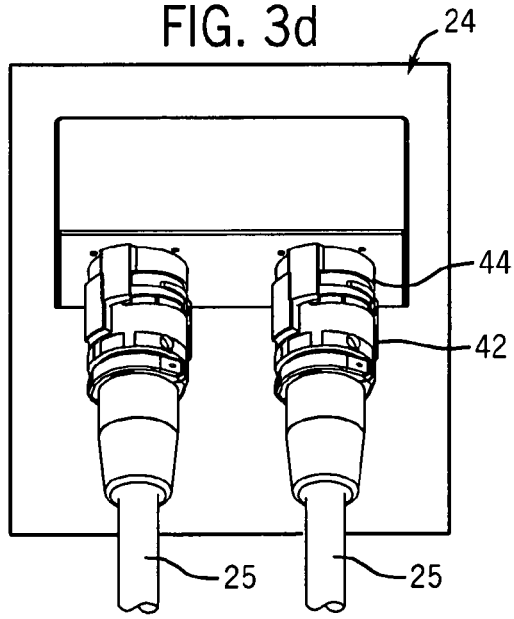

Referring generally to FIGS. 3*a*, 3*b*, 3*c* and 3*d*, these figures respectively illustrate an induction heating power source 24 with no connectors mated, with a protective plug disposed thereon, with fluid-cooled extension cables coupled thereto, and with air-cooled extension cables coupled thereto. Again, the extension cables (air or fluid-cooled) facilitate coupling of the induction heating power source 24 and induction heating device. As illustrated in FIG. 3*c*, each of the fluid-cooled extension cables 25 has a connector 42 that is connected to a corresponding connector 44 on the induction heating power source 24. The connectors 42 conduct electricity from the power source 24 to the fluid-cooled extension cables 25. External to the connectors 42, cooling fluid from the fluid cooling unit 36 is provided to the fluid-cooled induction heating cable 26 via hoses 46. The connectors 44 also enable an air-cooled induction extension cable to be connected to the induction heating power source 24. As will be discussed in more detail below, the induction heating power source 24 is operable to identify each type of extension cable connected to each connector 44. In addition, the induction heating power source 24 limits the output power of the induction heating power source 24 based on the types of extension cable connected to the connectors 44. In one embodiment, as shown in FIG. 3*b*, a protective plug 48 is provided to cover an unused connector 44. The induction heating power source 24 is also able to identify when a cover 48 is placed over a connector 44.

Figure 4:
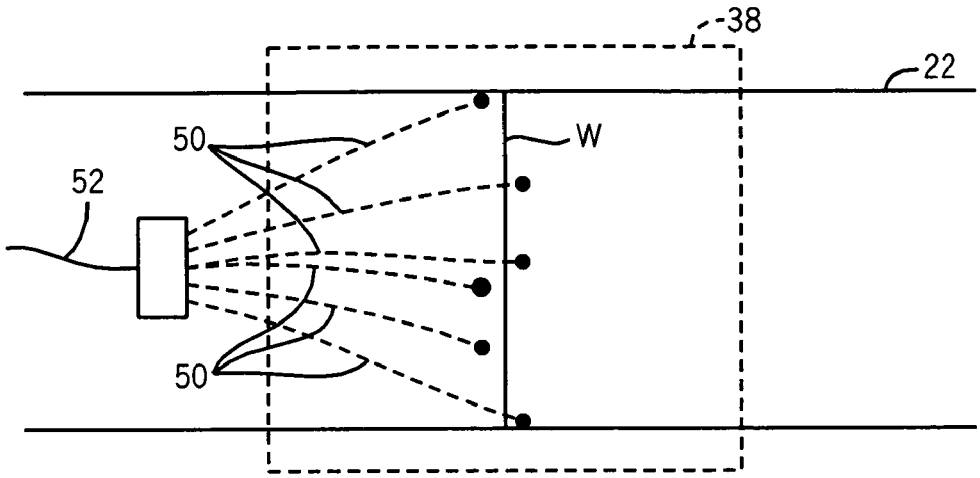
FIG. 4 is an elevation view of a work piece and a plurality of temperature feedback devices disposed on the work piece, according to an exemplary embodiment of the present technique.

Referring generally to FIGS. 1 and 4, the induction heating system 20 is operable to receive temperature feedback from a plurality of temperature feedback sensors 50, such as thermocouples, resistance temperature detectors (RTD's), or infrared sensors. These temperature feedback sensors 50 facilitate heating of the work piece 22 to a desired temperature and/or at a desired rate of temperature change. The exemplary thermocouples 50 are secured to the work piece 22 by spot welding and are coupled to the induction heating power source 24 by a thermocouple extension cable 52. As illustrated, the thermocouples are located about and proximate to a weld joint "W" extending circumferentially around the work piece 22.

Figure 5:
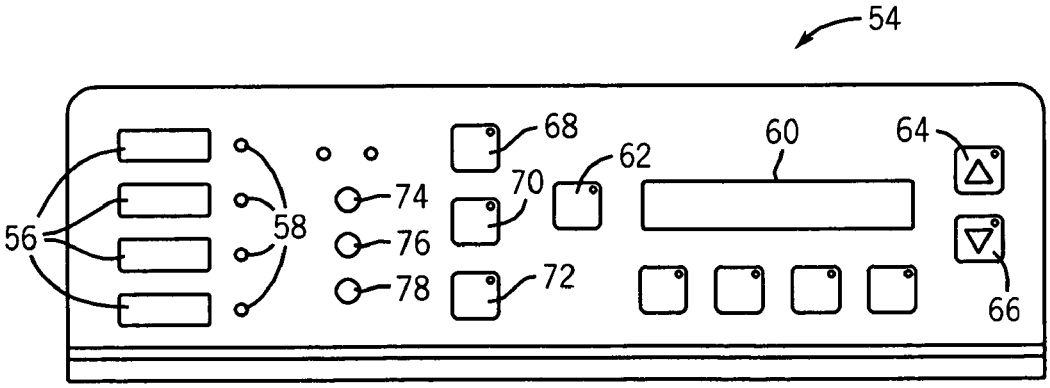
FIG. 5 is an elevation view of the control panel of the induction heating system of FIG. 1, according to an exemplary embodiment of the present technique.

Referring generally to FIG. 5, the illustrated induction heating power source 24 has a control panel 54 that enables a user to program the induction heating power source 24 to perform a variety of heating operations. For example, the control panel 54 may be used to program the induction heating power source 24 to heat the work piece 22 at a desired heat-up rate. In addition, the induction heating power source 24 may be programmed to maintain the work piece 22 at an elevated temperature for a desired period of time. The induction heating power source 24 may also be programmed to reduce the work piece temperature from an elevated temperature at a desired cool-down rate. It is worth noting that a number of operating programs having varied heating profiles are envisaged, and the foregoing techniques are merely examples.

To facilitate controlled operations of the induction heating power source 24 and the magnetic field created by the induction heating device 26, the exemplary embodiment includes the control panel 54, as discussed above. This control panel 54 has four temperature displays 56, one for each of four thermocouples 50 operable to control operation of the induction heating power source 24. The exemplary control panel 54 also has four control lights 58, one for each of the thermocouples 50 used to control temperature, to indicate which of the four control thermocouples 50 is controlling the operation of the system 20 at that point in time. In addition, the illustrated control panel 54 has a main display 60 to facilitate the programming of the induction heating power source 24 and for monitoring system parameters, such as the output power, output voltage and current and output frequency. Additionally, the display 60 is capable of providing program status information as well as diagnostic information should a problem arise. In this embodiment, the control panel 54 has a cursor button 62 that may be used in cooperation with the main display 60 to program the induction heating power source 24. In addition, the illustrated control panel 54 has an up arrow button 64 and a down arrow button 66 to enable a user to input data, such as a desired heat-up rate, a desired temperature, a desired time, and a desired cool-down rate.

The illustrated control panel 54 also has a run button 68, a hold button 70, and a stop button 72 that may be used to control the operation of the induction heating system 20. The run button 68 enables a user to initiate operation of the induction heating system 20. The hold button 70 enables a user to pause operation of the induction heating system 20 temporarily and maintain workpiece temperature. Operation restart of the induction heating system 20 in accordance with the programming instructions is achieved by pressing the run button 68. The stop button 72 halts operation of the system 20 completely. The control panel 54 may also have a light 74 to provide an indication to a user that a fault condition exists. Another light 76 may be provided to indicate to a user when an operating limit, such as output voltage or current, has been reached. Finally, a light 78 may be provided to indicate when power is being applied to the induction heating cables 26.

Figure 6:
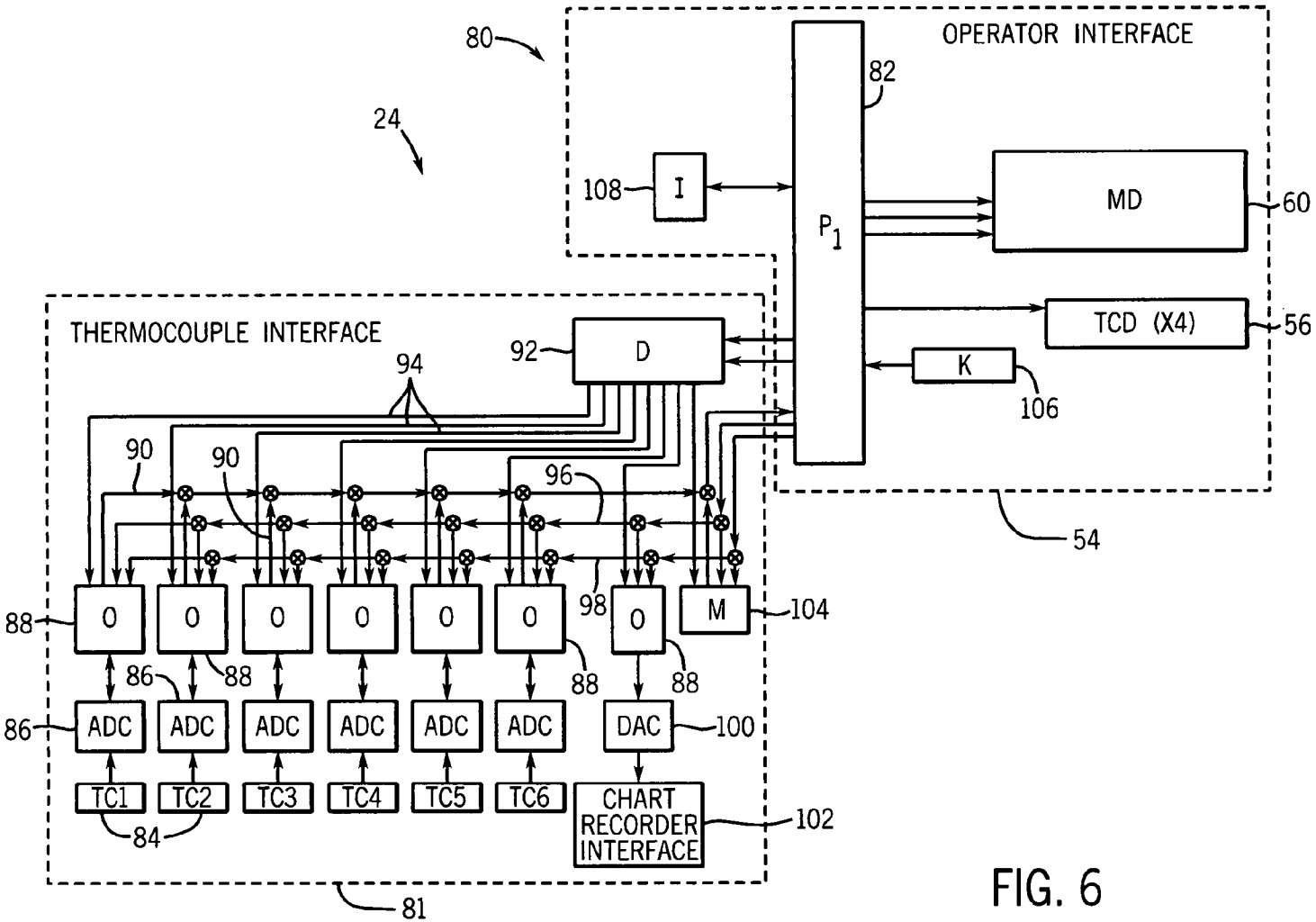
FIG. 6 is a schematic diagram of a temperature controller, according to an exemplary embodiment of the present technique.

Referring generally to FIG. 6, the induction heating power source 24 has a temperature control circuit 80 that includes a thermocouple interface board 81 and the control panel 54 for operator interface. The temperature control circuit 80 utilizes a processor 82, located on the operator interface 54, to direct operation of the induction heating system 20 in response to programming instructions received from the control panel 54 and temperature data received from the thermocouples 50 connected to the thermocouple interface board 81. The illustrated induction heating system 20 has six thermocouple inputs 84 to enable each of the six thermocouples 50 to be connected to the induction heating power source 24. Each of the thermocouple inputs 84 is coupled to an analog-to-digital converter (ADC) 86 that converts the analog temperature data from the thermocouples 50 into a digital temperature signal. Each ADC 86 is coupled to an optoisolator 88. Each optoisolator 88 couples the digital temperature signal from an ADC 86 to the processor 82 while maintaining electrical isolation of the processor 82 from each ADC 86. It is worth noting that multi-channel optoisolators are envisaged as well.

In this embodiment, the processor 82 receives digital temperature data from each ADC 86 sequentially. A number of circuit paths are provided to enable the processor 82 to communicate with each ADC 86 and a decoder 92. A first signal bus 90 is provided to couple the digital temperature data from each of ADC 86 to the processor 82. The decoder 92 is provided to control each ADC 86 to transmit the digital temperature data sequentially to the processor 82. A second signal bus 94 is provided to couple the decoder 92 to each ADC 86. A third signal bus 96 is provided to enable the processor 82 to communicate to each ADC 86. Each ADC 86 transmits its temperature data to the processor 82 when queued by the decoder 92 and the processor 82. A fourth signal bus 98 is provided to transmit calibration data to each ADC 86. A digital-to-analog converter (DAC) 100 is provided to couple the temperature data to a chart recorder via a chart recorder interface 102. In addition, a memory device 104 is provided to store calibration data.

The processor 82 is operable to receive programming instructions from the various programming buttons 106 disposed on the control panel 54. However, other methods of programming the processor 82 may be used. The programming buttons 106 comprises the cursor button, 62, the up arrow button, 64, the down arrow button, 66, the run button 68, the hold button, 70, the stop button 72, etc. The processor 82 may also provide signals to the temperature displays 56 and the main display 60. The processor 82 produces an output signal that is coupled to a power source controller interface 108.

Figure 7:
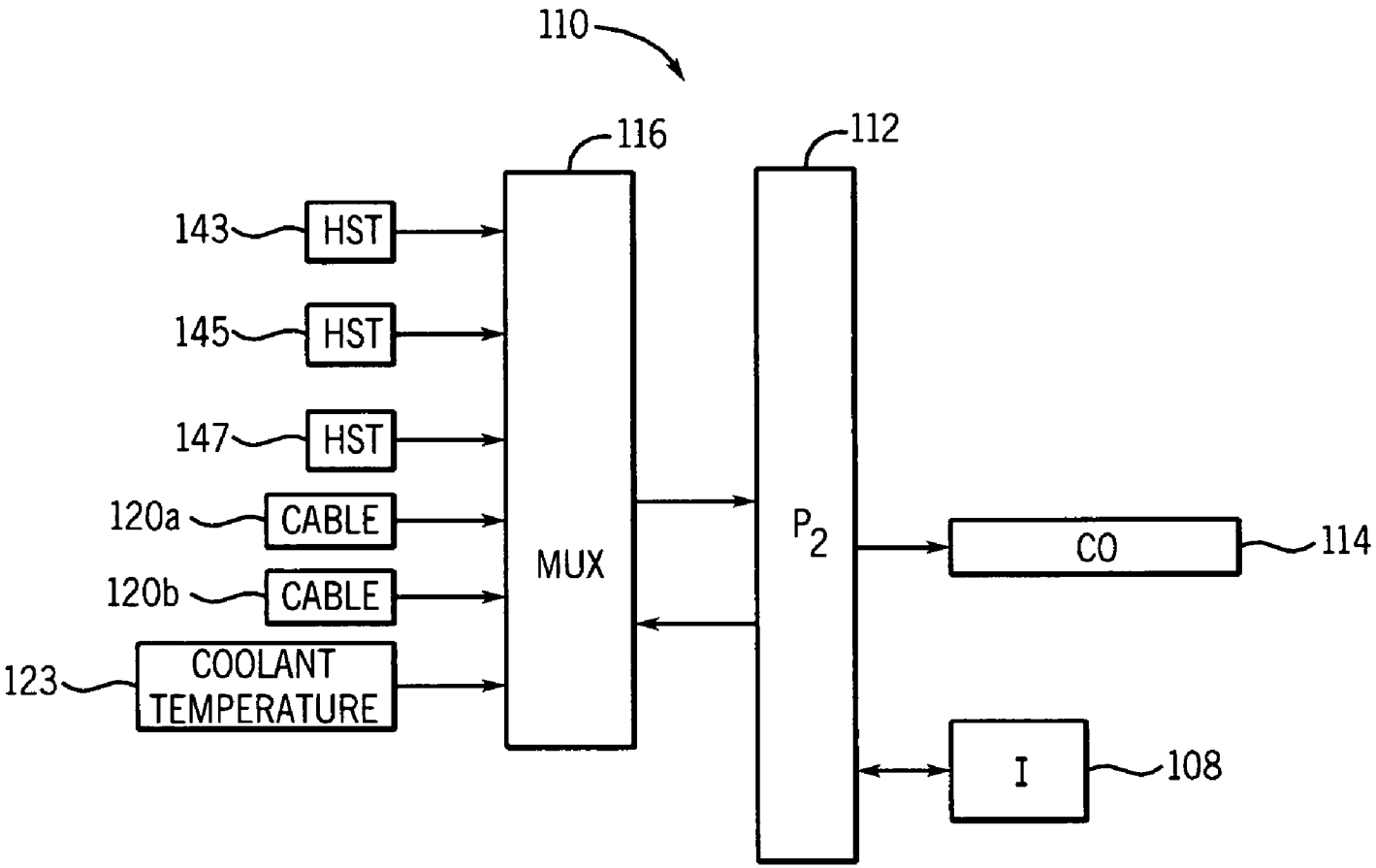
FIG. 7 is a schematic diagram of a power source controller, according to an exemplary embodiment of the present technique.

Referring generally to FIG. 7, the power source controller interface 108 couples the control signal from the temperature controller circuit 80 to an induction heating power source controller 110. The induction heating power source controller 110 has a processor 112 that provides a command signal 114 that controls the output of the induction heating power unit based on the control signal received from the processor 82 in the temperature controller circuit 80. The processor 112 also receives inputs from a multiplexer 116. As will be discussed in more detail below, the multiplexer 116 receives a thermocouple input 123 from the fluid cooling unit 36 and thermistor inputs 143, 145, and 147 from a plurality of thermistors 142, 144 and 148, respectively, disposed within the induction heating power source 24 (see FIG. 8). In addition, the multiplexer 116 receives an identifier signal 120*a* or 120*b* representative of the type of induction heating extension cable employed from the induction heating power source connectors 44 illustrated in FIGS. 3*a*-3*d*. Each type of induction heating extension cable (air-cooled or fluid-cooled) that may be connected to the induction heating power source 24 has its own unique identifier. The processor 112 is programmed to adjust or limit power to the induction heating device based on its type. Additionally, the processor 112 is programmed to not permit operation if the induction heating device types are different or if an unused output connection does not have a protective plug in place to signify it as an unused connection. In addition to control based on input from temperature control circuit 80, the power source controller 110 is operable to control power from the induction heating power source 24 based on the heatsink thermistor inputs 143, 145 and 147, the extension cable connector identifier inputs 120*a* or 120*b*, and the coolant temperature input 123.

Figure 8:
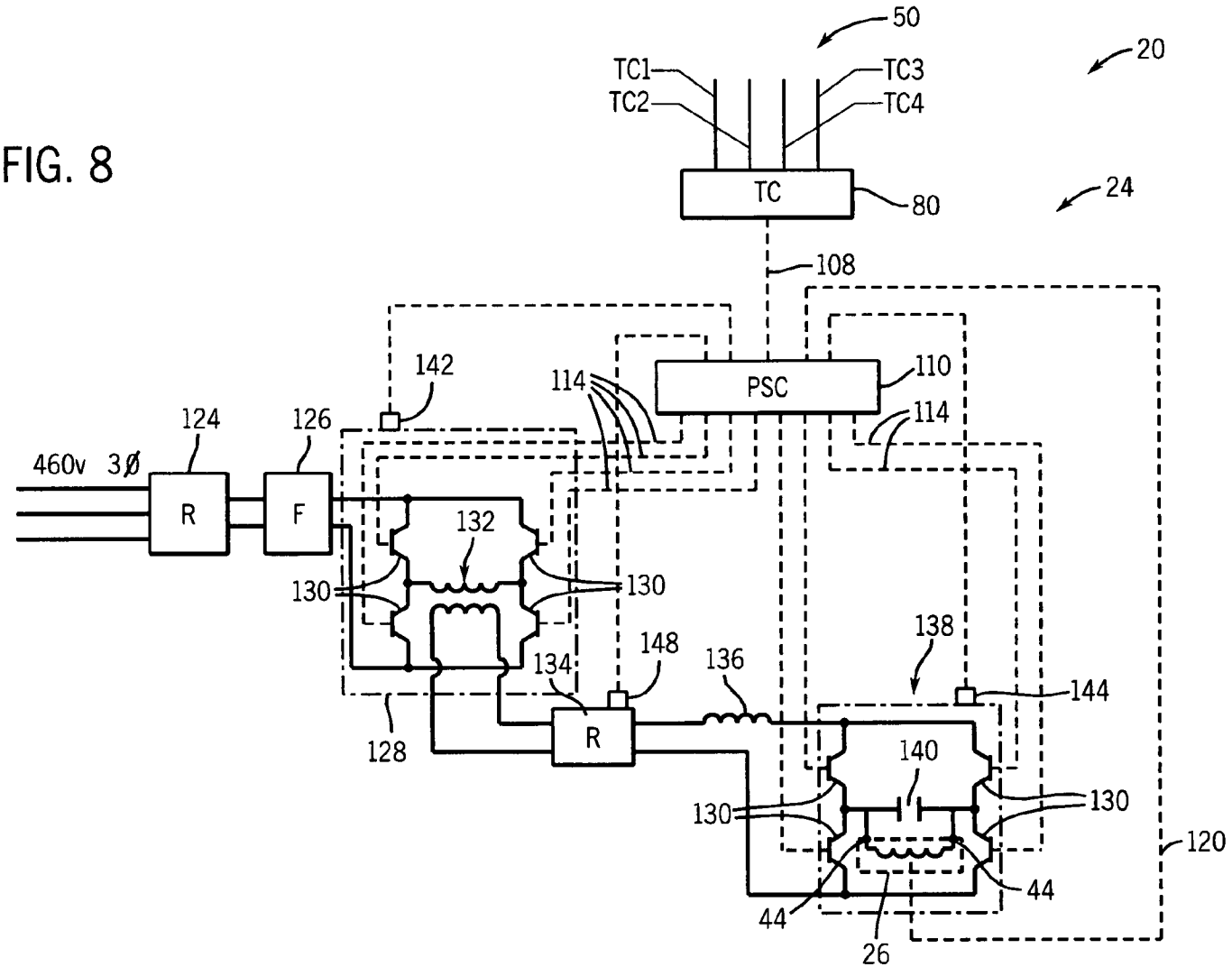
FIG. 8 is a schematic diagram of the induction heating system, according to an exemplary embodiment of the present technique.

Referring generally to FIG. 8, an electrical schematic of the induction heating system 20 is illustrated. The temperature controller 80 receives the temperature feedback from the plurality of temperature feedback devices 50. The temperature controller 80 compares the actual temperature of the work piece 22, represented by the temperature feedback, to a desired temperature based on programming instructions stored in the temperature controller 80. The temperature controller 80 provides a signal 108 to the power source controller 110 that is representative of a desired output of the induction heating power source 24 to make the actual temperature of the work piece 22 equal to the desired temperature. The power source controller 110 controls the operation of the induction heating power source 24 to provide the desired output. As will be discussed in more detail below, the power source controller 110 controls the output of the induction heating power source 24 by controlling the opening and closing of electronic switches in a pair of inverter circuits. By selectively increasing or decreasing the frequency that the electronic switches 130 are opened and closed, the output of the induction heating power source 24 may be increased or decreased as desired.

In the illustrated embodiment three-phase AC input power is coupled to the induction heating power source 24. A rectifier 124 is used to convert the AC power into DC power. A filter 126 is used to condition the rectified DC power signals. A first inverter circuit 128 is used to invert the DC power into desired AC output power. In the illustrated embodiment, the first inverter circuit 128 comprises a plurality of electronic switches 130, such as IGBTs. The electronic switches 130 are opened and closed by command signals 114 from the power source controller 110. The power source controller 110 controls the operation of the electronic switches 130 to provide the desired output of the induction heating power source 24. A step-down transformer 132 is used to couple the AC output from the first inverter circuit 128 to a second rectifier circuit 134, where the AC is converted again to DC. An inductor 136 is used to smooth the rectified DC output from the second rectifier 134. The output of the second rectifier 134 is coupled to a second inverter circuit 138. The second inverter circuit 138 converts the DC output into high-frequency AC signals. The electronic switches 130 of the second inverter circuit 138 also are opened and closed by command signals 114 from the power source controller 110. The power source controller 110 controls the operation of the electronic switches 130 to provide the desired output of the induction heating power source. A tank capacitor 140 is coupled in parallel with the output connectors 44. As illustrated, the fluid-cooled induction heating cable 26 is connected to connectors 44. However, an air-cooled induction heating device may be coupled to connectors 44.

The coiled fluid-cooled induction heating cable 26 is represented on the schematic as an inductor. The inductance of the induction heating cable 26 and the tank capacitor 140 form a resonant tank circuit. The inductance and capacitance of the resonant tank circuit establishes the frequency of the AC current flowing through the fluid-cooled induction heating cable 26. The inductance of the fluid-cooled induction heating cable 26 is influenced by the number of turns of the induction heating cable 26 around the work piece 22. As discussed above, the current flowing through the fluid-cooled induction heating cable 26 produces the magnetic field that induces eddy current flow, and, thus, heat in the work piece 22.

A large amount of electrical current may flow through the various components of the induction heating power source 24 and the induction heating cable 26. This current produces heat within the power source 24 that may damage the components. Solid-state components, such as the IGBTs 130 and the rectifiers, are particularly susceptible to heat damage. In the illustrated embodiment, the power source 24 is adapted to control output power to prevent heat damage to certain components. One or more temperature feed back devices, such as thermistor, are disposed within the induction heating power source 24 to provide temperature signals to the power source controller 110. A thermistor 142 is disposed adjacent to the first inverter 128 to provide a signal representative of the temperature of the first inverter 128 to the power source controller 110. Another thermistor 144 is disposed adjacent to the second inverter 138 to provide a signal representative of the temperature of the second inverter 138 to the power source controller 110. Yet another thermistor 148 is provided to provide a signal representative of the temperature of the rectifier 134 to the power source controller 110.

In addition to the signal 108 from the temperature controller 80 that is representative of a desired output of the induction heating power source 24, the power source controller 110 also receives signals from other sources that are used to control the output of the induction heating power source 24. For example, temperature signals from the first thermistor 142, the second thermistor 144, the third thermistor 148, and a coolant temperature signal 123 from the fluid-cooling unit (illustrated in FIG. 7), and an identifier signal 120*a* or 120*b* representative of the type of induction heating extension cable connected to the induction heating power source 24 are provided to the power source controller 110. The power source controller 110 receives a command signal from the temperature controller 80 to produce a desired output. However, if any of the parameters of the desired output are above the limits for the induction heating device connected to the induction heating power source 24, the power source controller 110 limits output power to the limits for the specific induction heating device. Similarly, if the temperature signals from thermistors 142, 144, 148 from the various induction heating system components is above a setpoint, or coolant temperature feedback is above a setpoint, the power source controller 110 limits or reduces power from the induction heating power source 24. However, a variety of control schemes may be used to control the output of the induction heating power source 24 based on the temperature signals from the induction heating system components and the type of induction heating devices connected to the induction heating power source 24. The foregoing are merely examples of control schemes, and a host of various control schemes are envisaged, although not discussed for clarity. Indeed, the system may be responsive to any combination or permutation of inputs from the signal producing devices, such as thermistors or the thermocouples, for instance, located throughout the system.

As noted above, the power source controller 110 is programmed to limit the signal 108 from the temperature controller 80 so that the induction heating power source 24 is not driven to produce additional power when a specified induction heating system component temperature is reached. The power source controller 110 is also programmed to reduce the amount of power produced by the induction heating power source 24 when a specified induction heating system component temperature limit threshold is reached. Additionally, the power source controller 110 is programmed to stop operation of the induction heating power source 24 if a specified component maximum temperature threshold is reached or exceeded. Limiting or reducing the desired output of the induction heating power source 24 reduces the amount of heat produced within the system 20, thereby, protecting induction heating system components from heat damage.

In addition, as noted above, the power source controller 110 is programmed to automatically limit the output power from the induction heating power source 24 based on the specific induction heating extension cable connected to the induction heating power source 24. In the illustrated embodiment, two different kinds of induction heating extension cables 25 may be electrically coupled to the induction heating power source 24. For example, a fluid-cooled induction heating extension cable or an air-cooled induction heating extension cable may be coupled to the induction heating power source 24. To prevent damage, when multiple extension cables are connected, the induction heating extension cables must be of the same type, or the power source will not deliver output. Each of these induction heating extension cables is operable to provide a signal representative of the specific type to the induction heating power source 24. Thus, the induction heating system intelligently determines appropriate output power or if power should be provided at all. As will be explained in more detail, the fluid-cooled extension cable is designed to accommodate only fluid-cooled induction heating devices and the air-cooled extension cable is designed to accommodate only air-cooled induction heating devices.

Figure 9:
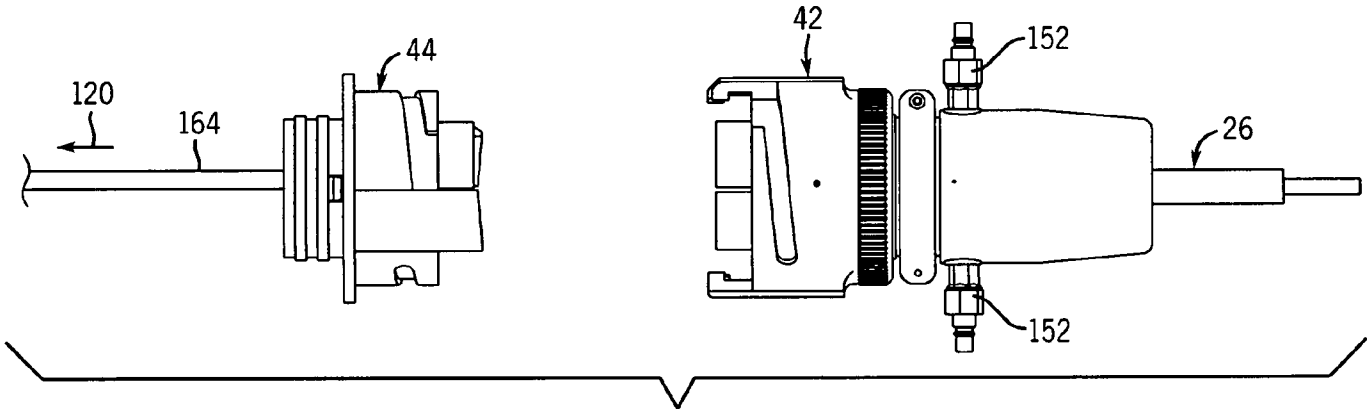
FIG. 9 is an elevation view of an induction heating power source connector and an induction heating fluid-cooled extension cable connector, according to an exemplary embodiment of the present technique.
Figure 11:
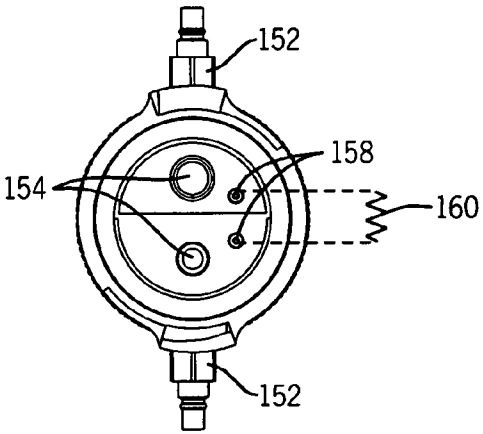
FIG. 11 is a front elevation view of the induction heating fluid-cooled extension cable connector of FIG. 9.
Figure 10:
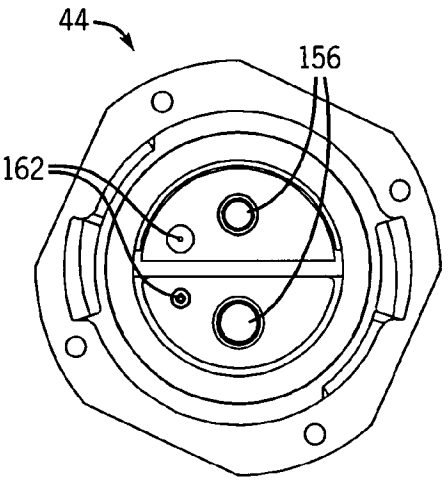
FIG. 10 is a front elevation view of the induction heating power source connector of FIG. 9.

Referring generally to FIGS. 9-11, a fluid-cooled induction heating extension cable 25 may be connected to the induction heating power source 24. The illustrated fluid-cooled induction heating extension cable connector 42 has a pair of fluid connectors 152 for coupling cooling fluid to and from the fluid-cooled induction heating extension cable 25. In addition, the fluid-cooled induction heating extension cable connector 42 has a pair of high power contacts 154 that are inserted into a corresponding pair of high power contacts 156 on the induction heating power source connector 44 to couple power from the induction heating power source 24 to the fluid-cooled induction heating extension cable 25. The induction heating extension cable connector 42 also has a second pair of low power contacts 158. An electrical resistor 160 housed within the connector 42 is connected between the two low power contacts 158 and serves as an identifier for the fluid-cooled induction heating extension cable 25. In addition, the induction heating power source connector 44 has a second pair of low power contacts 162 that receive the two low power contacts 158 when the fluid-cooled induction heating extension cable connector 42 is connected to the induction heating power source connector 44. The second pair of low power contacts 162 couple the resistance of the electrical resistor 160, i.e., the source of the identifier 120*a* or 120*b*, to the power source controller 110 of FIGS. 7 and 8 via lead 164. The power source controller 110 receives the unique identifier 120*a* or 120*b* from the fluid-cooled induction heating extension cable 25 and limits the output of the induction heating power source 24 based on the unique identifier. The value of the electrical resistance of the electrical resistor 160 may correspond to the operating limit of the induction heating device.

Figure 12:
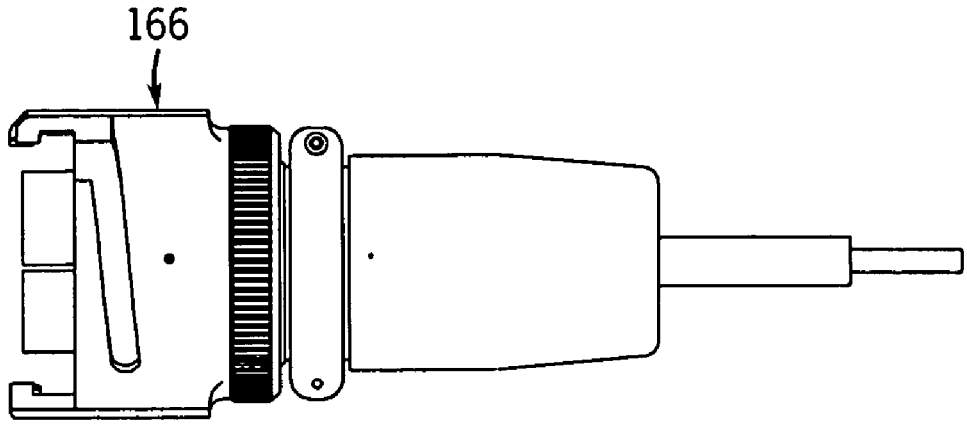
FIG. 12 is an elevation view of an induction heating air-cooled extension cable connector, according to an exemplary embodiment of the present technique.
Figure 13:
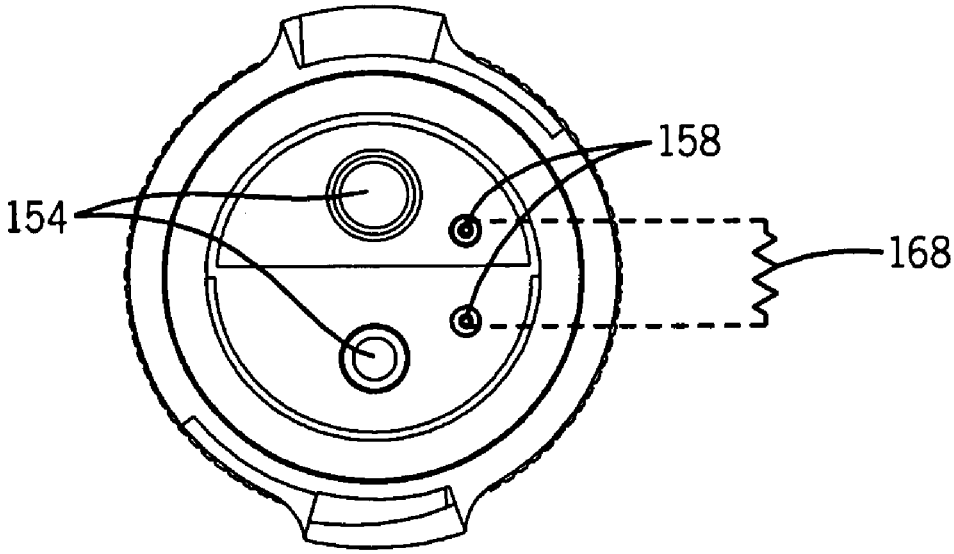
FIG. 13 is a front elevation view of the air-cooled induction heating extension cable connector of FIG. 12.

Referring generally to FIGS. 12 and 13, an air-cooled induction heating extension cable connector 166 is illustrated. The air-cooled induction heating extension cable connector 166 also has a resistor 168 coupled between a pair of identifier contacts 158. However, the value of the electrical resistance of the resistor 168 in the air-cooled induction heating extension cable connector 166 is different than the value of the electrical resistance of the resistor 160 in the fluid-cooled induction heating extension cable connector 42. The unique resistance signal 120*a* and 120*b* is transmitted from the air-cooled induction heating extension cable connector 166 to the power source controller 110 of FIG. 8. The power source controller 110 of FIG. 8 receives the unique resistance signal 120*a* or 120*b* and limits the output of the induction heating power source to a second operational limit. Thus, the induction heating power source 24 is operable to limit output of the induction heating power source 24 specifically for each induction heating device electrically coupled to the induction heating power source 24.

Figure 14:
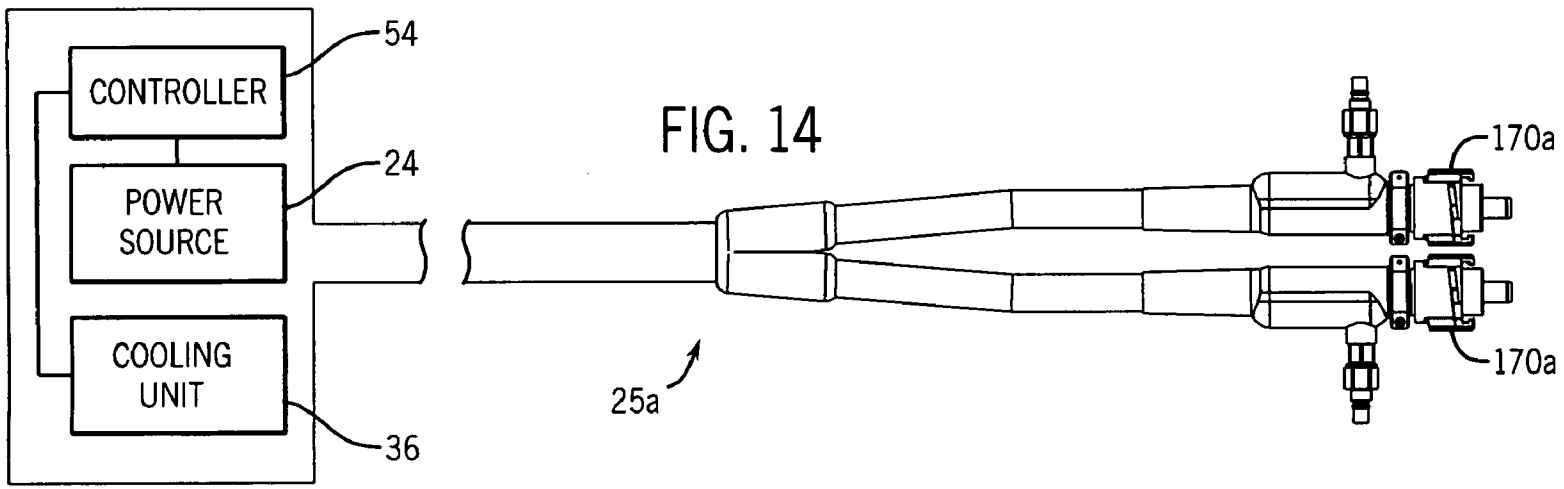
FIG. 14 illustrates a liquid-cooled extension cable, according to an exemplary embodiment of the present technique.
Figure 15:
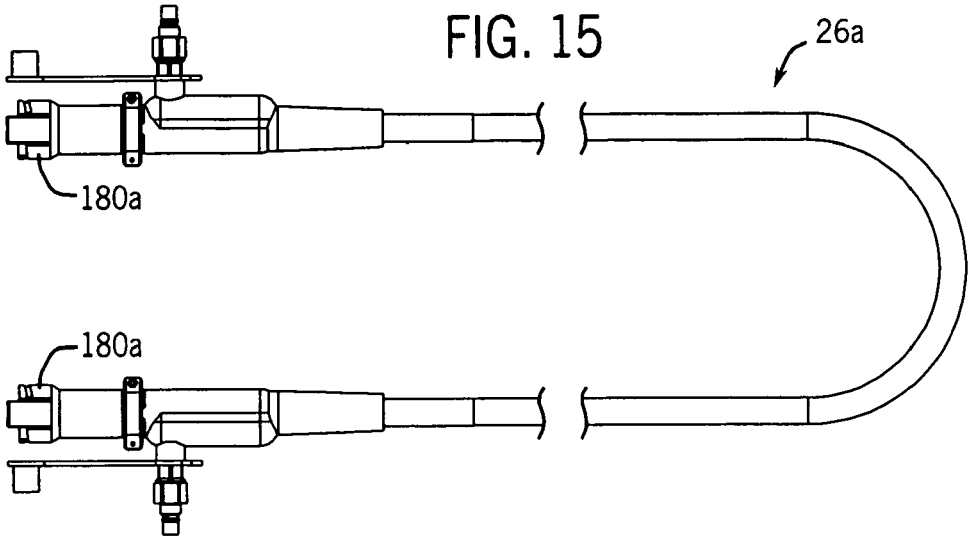
FIG. 15 illustrates a liquid-cooled induction heating device, according to an exemplary embodiment of the present technique.

Turning to FIG. 14, this figure illustrates the heating device end of a liquid-cooled extension cable 25*a*. As illustrated, the device end is located opposite the end of the liquid-cooled extension cable 25*a* that is proximately coupled to the controller 54 and power source 24, and cooling unit 36. The device end of the liquid-cooled extension cable 25 includes a pair of male connectors 170*a*, and these male connectors 170*a* are configured to engage with corresponding female connectors 180*a* of the liquid-cooled induction heating cable 26*a* illustrated in FIG. 15. In the illustrated embodiment, the male connectors 170*a* and the female connectors 180*a* are configured such that only appropriately corresponding extension cables and induction heating cables may be coupled to one another. That is, as is illustrated in FIGS. 14 and 15, the male connectors 170*a* and the female connectors 180*a* ensure that only a liquid-cooled induction heating cable 26*a* may be coupled to the liquid-cooled extension cable 25*a*. Thus, the output parameters of the induction system 20 are limited for effective operation of the liquid cooled induction heating cable 26*a*.

Figure 16:
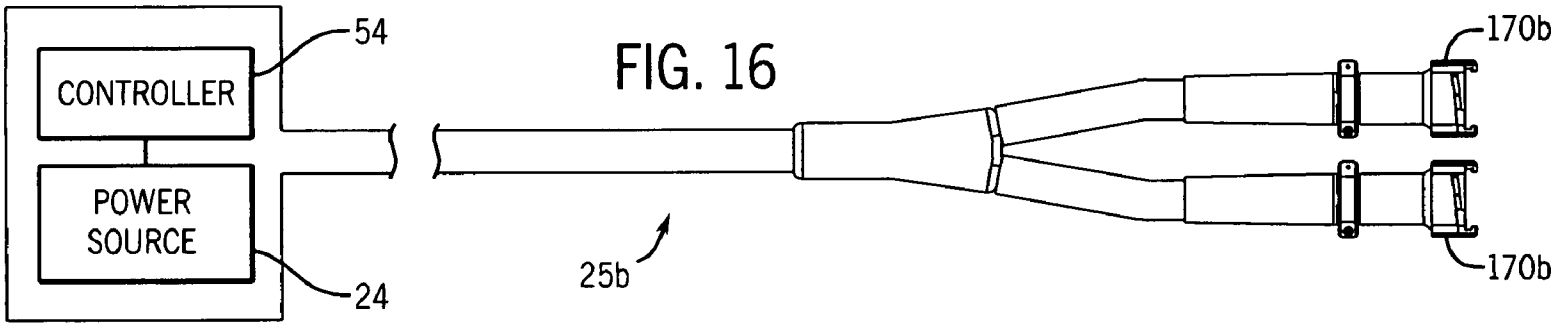
FIG. 16 illustrates an air-cooled extension cable, according to an exemplary embodiment of the present technique.
Figure 17:
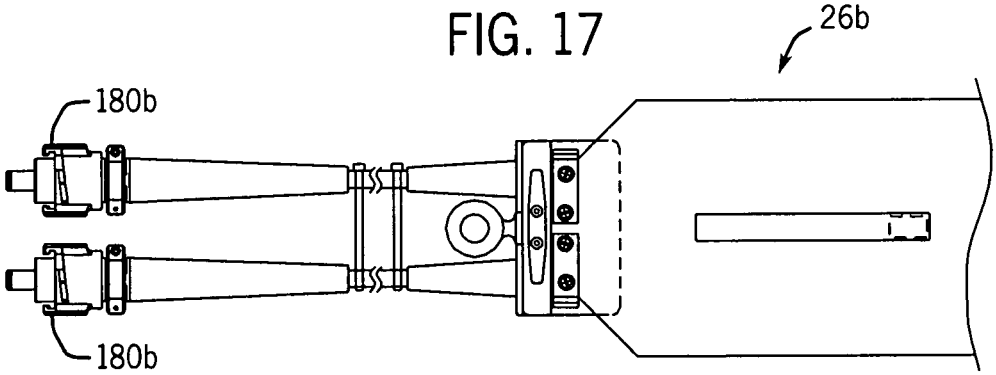
FIG. 17 illustrates an air-cooled heating blanket, according to an exemplary embodiment of the present technique.
Figure 18:
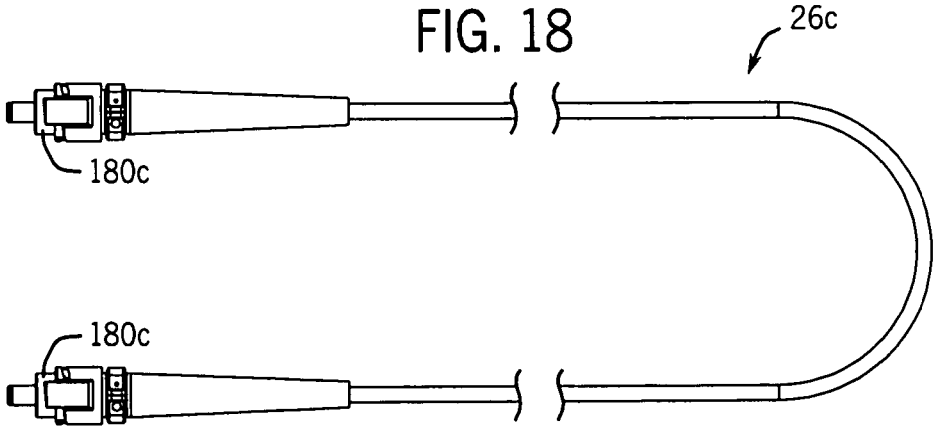
FIG. 18 illustrates an air-cooled induction heating cable, according to an exemplary embodiment of the present technique.

Similarly, the air-cooled extension cable 25*b* illustrated in FIG. 16 includes female connectors 170*b* that are configured to mate with corresponding male connectors 180*b* of the air-cooled induction heating blanket 26*b* of FIG. 17, or with male connectors 180*c* of the air-cooled induction heating cable 26*c* of FIG. 18. These connectors 170*b*, 180*b*, and 180*c* are constructed in such a manner as to ensure that only air-cooled induction heating devices (e.g., air-cooled heating blanket 26*b* and air-cooled induction heating cable 26*c*) can be coupled to the air-cooled extension cable 25*b*. Moreover, the configuration specific genders of the extension cables and induction devices ensure that an air-cooled extension cable 25*b* is not inadvertently coupled to a liquid-cooled induction device, and vice-versa. Thus, the likelihood of damage due to operation of the induction device outside desired operating parameters is reduced.

The techniques described above provide a system 20 and a method for inductively heating a work piece 22. In addition, the techniques protects induction heating devices used with the system 20 from damage by limiting the amount of power that may be applied to the induction heating devices based on the type of induction heating device used. In addition, the system 20 performs the identification of the induction heating device automatically.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. An induction heating system, comprising:

an induction heating device electrically coupleable to an induction heating power source operable to provide power to induction heating devices of different types, wherein an induction heating extension cable or the induction heating device or any combination thereof is operable to provide a signal representative of the induction heating device to the inductive heating power source, wherein the signal representative of the induction heating device is configured to identify a coolant type of the induction heating device.

2. The system as recited in claim 1, comprising the induction heating power source, wherein the induction heating power source is operable to control the induction heating power source output based on the signal representative of the induction heating device.

3. The system as recited in claim 2, wherein the induction heating power source is operable to limit output of the induction heating power source based on the signal representative of the induction heating device.

4. The system as recited in claim 2, wherein the induction heating power source is operable to provide a desired output based on at least one signal representative of work piece temperature, and wherein the induction heating power source automatically limits actual output of the induction heating power source based on the signal representative of the induction heating device.

5. The system as recited in claim 2, wherein the induction heating device comprises a first electrical connector operable to couple the output of the induction heating power source to the induction heating device to produce a varying magnetic field.

6. The system as recited in claim 5, wherein the induction heating device comprises a second electrical connector operable to couple an electrical component to the induction heating power source, wherein the electrical component has a value that is recognized by the induction heating power source as corresponding to a specific induction heating device type.

7. The system as recited in claim 6, wherein the electrical component comprises a resistor.

8. The system as recited in claim 1, wherein the signal representative of the induction heating device is configured to identify the induction heating device.

9. The system as recited in claim 1, wherein the coolant type comprises a liquid coolant.

10. The system as recited in claim 1, wherein the coolant type comprises a gas coolant.

11. The system as recited in claim 1, wherein the induction heating power source is configured to establish a specific output limit based on the signal configured to identify the coolant type of the induction heating device.

12. The system as recited in claim 11, wherein the coolant type comprises a liquid coolant or a gas coolant.

13. An induction heating system, comprising:

an induction heating power source configured to electrically couple to an induction heating device having first and second electrical connectors, wherein the first electrical connector is configured to couple an output of the induction heating power source to the induction heating device to produce a varying magnetic field, the second electrical connector is configured to couple an electrical component to the induction heating power source, the induction heating power source is operable to automatically establish a specific output limit from among a plurality of different output limits based on a value representative of a specific induction heating device type of the induction heating device electrically coupled to the induction heating power source, and the electrical component has the value that is recognized by the induction heating power source as corresponding to the specific induction heating device type.

14. The system as recited in claim 13, comprising the induction heating device, wherein the induction heating device is operable to provide a signal with the value representative of the specific induction heating device type to the induction heating power source to enable the induction heating power source to establish the specific output limit corresponding to the induction heating device.

15. The system as recited in claim 13, wherein the induction heating power source is operable to produce a desired induction heating power source output based on another signal representative of work piece temperature received from a temperature feedback device, and wherein the induction heating power source is configured to limit actual induction heating power source output based on the specific output limit.

16. An induction heating system, comprising:

an induction heating power source electrically coupleable to an induction heating device, wherein the induction heating power source is configured to establish a specific output limit from among a plurality of different output limits based on an identity of the induction heating device electrically coupled to the induction heating power source, wherein the identity of the induction heating device is based on a signal configured to identify a coolant type.

17. The system as recited in claim 16, wherein the identity of the induction heating device is based on a signal configured to identify the induction heating device type.

18. The system as recited in claim 16, wherein the coolant type comprises a liquid coolant or a gas coolant.

19. An induction heating system, comprising:

an induction heating device configured to electrically couple to an induction heating power source operable to provide power to induction heating devices of different types, wherein the induction heating device comprises:

a first electrical connector configured to couple an output of the induction heating power source to the induction heating device to produce a varying magnetic field; and a second electrical connector configured to couple an electrical component to the induction heating power source, wherein the electrical component has a value that is recognized by the induction heating power source as corresponding to a specific induction heating device type.

20. The system as recited in claim 19, comprising the induction heating power source.

21. The system as recited in claim 20, wherein the induction heating power source is configured to control the output based on the value corresponding to the specific induction heating device type.

22. The system as recited in claim 20, wherein the induction heating power source is configured to control the output based on a signal configured to identify a coolant type.

23. The system as recited in claim 20, wherein the induction heating power source is configured to control the output based on a signal from an extension cable.

* * * * *